US006113153A

United States Patent [19]

Yang

[11] Patent Number: 6,113,153

[45] Date of Patent: Sep. 5, 2000

[54] STRUCTURE OF A WATER SPRAY HOSE DEVICE

[76] Inventor: Ming-Shun Yang, 2nd Fl. No. 4, Lane 323, Chia-Hsing St., Taipei, Taiwan

[21] Appl. No.: 09/092,302

[22] Filed: Jun. 5, 1998

[51] Int. Cl.[7] ..... F16L 9/14

[52] U.S. Cl. ..... 285/55; 243/322; 138/119; 138/128

[58] Field of Search ..... 138/119, 128, 138/109; 285/243, 148.3, 242, 55, 322

[56] References Cited

U.S. PATENT DOCUMENTS

| | | | |
|---|---|---|---|
| 31,614 | 3/1861 | Mayall | 138/128 X |
| 2,595,408 | 5/1952 | Quest | 138/128 X |
| 3,032,151 | 5/1962 | Allen et al. | 138/128 X |
| 3,084,961 | 4/1963 | Merriman | 285/242 |
| 4,467,837 | 8/1984 | Baker | 138/119 |
| 4,478,661 | 10/1984 | Lewis | 138/128 X |

FOREIGN PATENT DOCUMENTS

| | | | |
|---|---|---|---|
| 279295 | 8/1965 | Australia | 285/243 |

*Primary Examiner*—Dave W. Arola
*Attorney, Agent, or Firm*—Erik M. Arnhiem

[57] ABSTRACT

A water spray hose device includes a water spray hose and two connectors at the two ends of the water spray hose. The water spray hose consists of a rubber hose, a first nylon fiber layer, and a second nylon fiber layer. Each connector consists of a primary connector, a screw collar, and two semicircular splints. At the front of the semicircular splints there are several deflectable elastic walls for gripping the spray hose.

2 Claims, 10 Drawing Sheets

STRUCTURE OF A WATER SPRAY HOSE DEVICE

BACKGROUND OF THE INVENTION:

The inventor has a U.S. patent application, Water Spray Hose Rolling Device, U.S. Pat. No. 5,655,728 (as shown in FIG. 1). Users use it to spray the garden or to wash cars. While not in use, the scattered hose can be drawn into the rolling device (100) and the residual water in the water spray hose can be squeezed out to prolong the life of the water spray hose. The invention therefore is very practical.

FIGS. 2 and 3 show a water spray hose (A) of the above invention. It consists of an inner rubber hose (B) and an outer nylon fiber hose (C). The two flat folding points (D) at the two ends of the inner rubber hose (B) and the outer nylon fiber hose (C) may not be entirely stable. After numerous rolling of the water spray hose (A), the inner hose (B) and the outer hose (C) may be deformed and displaced. This is because of the elastic deformation of the flat folding points (D) (as shown in FIG. 4) when the hose (B) and hose (C) are inserted into a holder (E). This not only causes the water spray hose (A) to wind when rolling (as shown in FIG. 5), but also tends to damage the water spray hose (A) because the residual water in the water spray hose can not be squeezed out, and the foul water corrodes the interior of the water spray hose. There are some drawbacks of the conventional water spray hose (A).

In addition; referring to FIGS. 1, 2, 5, 6, and 7, an inlet connector (10) is provided at one open end of the water spray hose (A) and a spray connector (20) is provided at the other end. Since the designs of the two connectors are identical, a description of the inlet connector (10) will apply to both connectors. The inlet connector (10) consists of a connector (12), a holding casing pipe (11), a shell toggle (14) and a screw collar (15). The end of the water spray hose (A) is inserted through the holding casing pipe (11), then connected tightly with a spray nozzle (13) and the connector (12) by using the shell toggle (14) and the screw collar (15) outside of the holding casing pipe (11) When the interior thread (15A) of the screw collar (15) is tightened on the exterior threat (12A) of the connector (12), the shell (14A) of the shell toggle (14) is contracted and fasten to fix the screw collar (15) with the shell toggle (14), the holding casing pipe (11), the water spray hose (A), and the connector (12) tightly together.

The water spray hose (A) is connected to the connector (12) by stuffing tie water hose into the holding casing pipe (11). They can not be securely fastened by the friction between the interior wall of the holding casing pipe (11) and the outer wall of the water spray hoses The shell toggle (14) and the shell (14A) of the shell toggle can not effectively clamp the water spray hose directly to nozzle 13. When the water pressure is too strong, the water spray hose will separate from the connector (12). This is, a disadvantage of the inlet connector (10).

Because of the design the water spray hose and the inlet connector of the aforesaid invention, the primary objective of the present invention is to provide an improved design of the water spray hose device, not only to improve the winding action of water spray hose, but also to provide a stronger connection between the water spray hose and the inlet connector.

SUMMARY OF THE INVENTION

A water spray hose device includes a water spray hose and two connectors at the two ends of the water spray hose. The water spray hose consists of a rubber hose, a first nylon fiber layer, and a second nylon fiber layer. Each connector consists of a primary connector, a screw collar, and two semicircular splints. At the ends of the semicircular splints there are several juxtaposed elastic shells.

DETAILED DESCRIPTION

Figure 1:
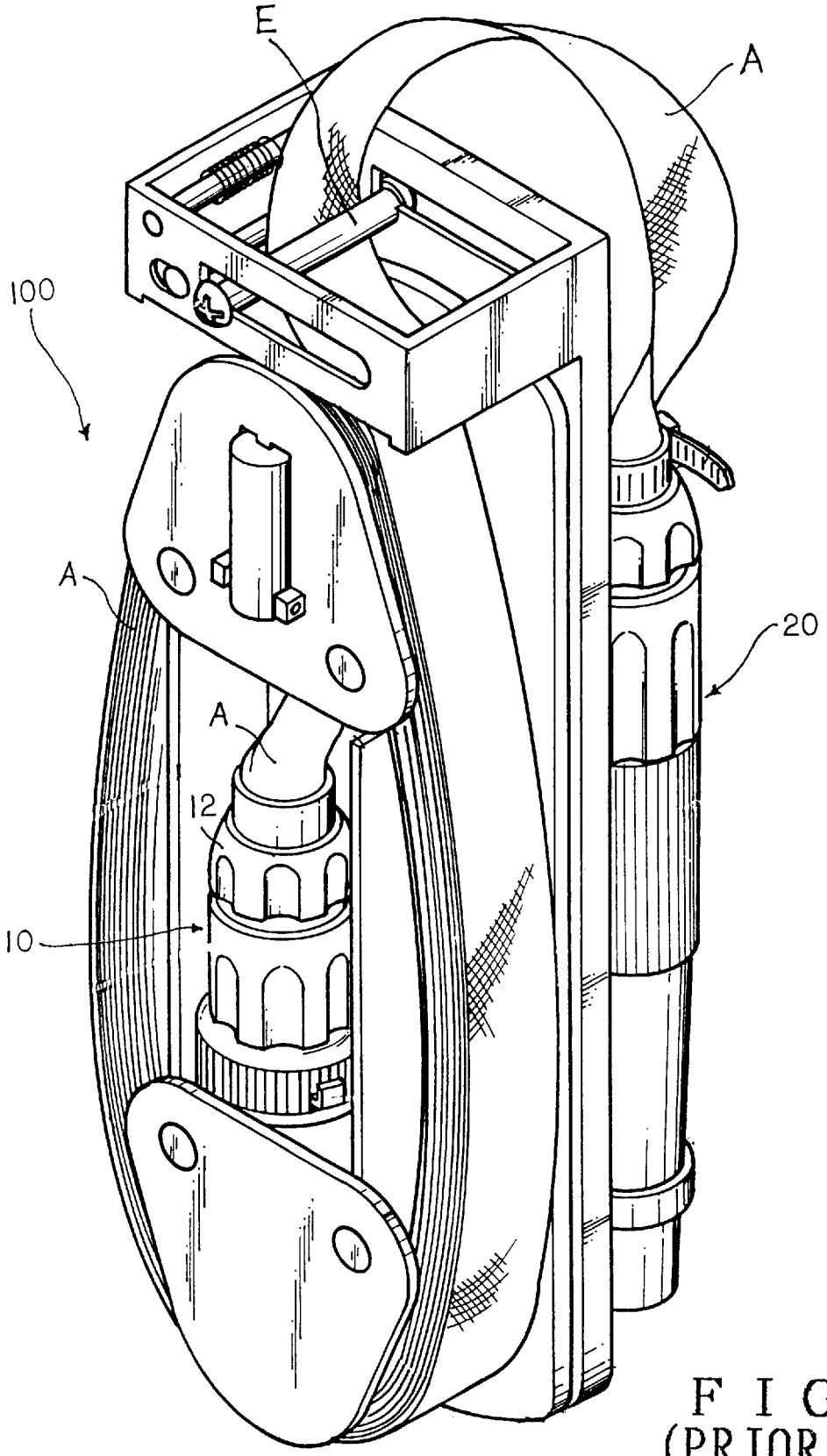
FIG. 1 (PRIOR ART)
FIG. 1 is an appearance view of the rolling device (100) of the U.S. patent application, U.S. Pat. No. 5,655,728.
Figure 2:
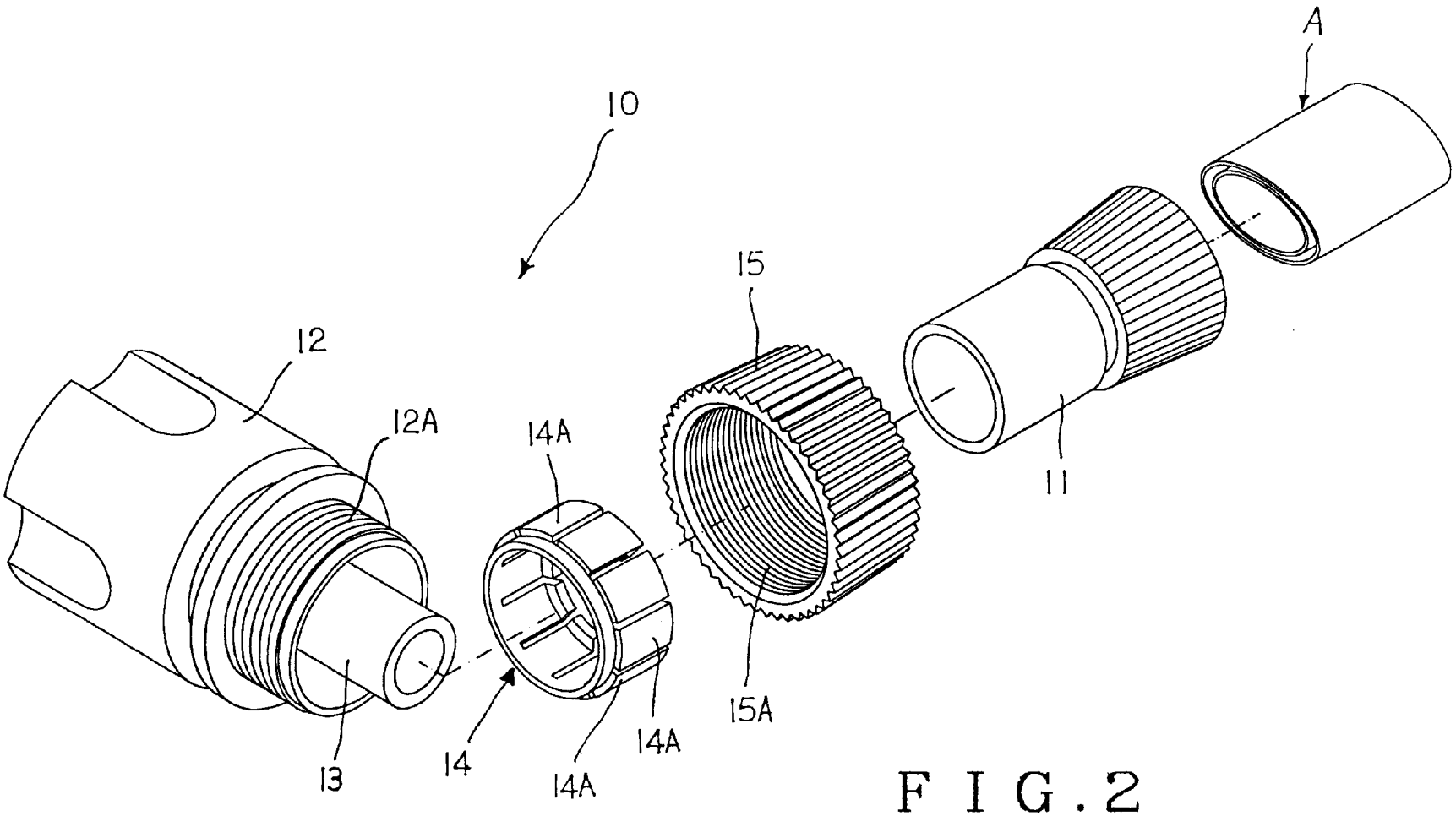
FIG. 2 (PRIOR ART)
FIG. 2 is and exploded view of the connector (10) and the water spray hose (A) of FIG. 1.
Figure 4:
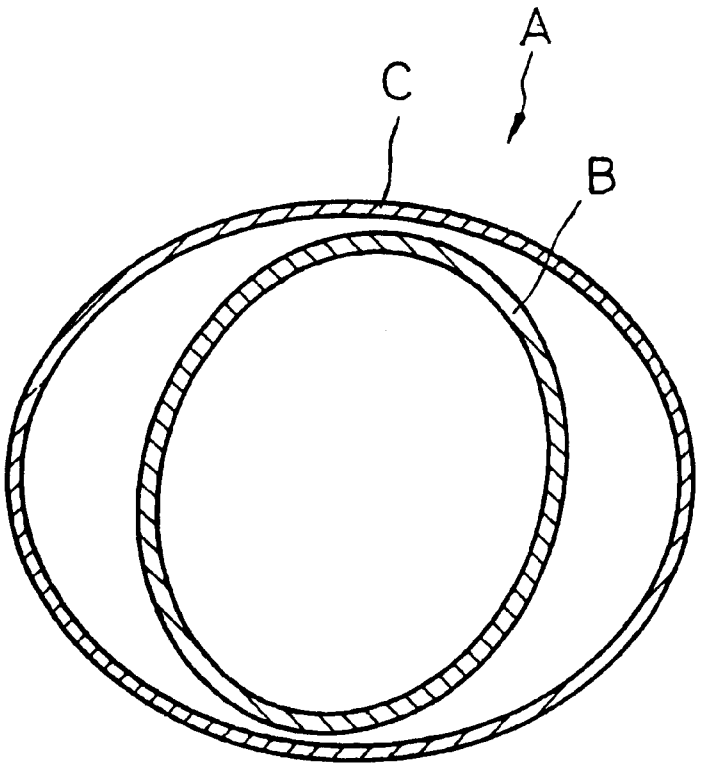
FIG. 4 (PRIOR ART)
FIG. 4 is an optional view showing the inner rubber hose (B) and the outer nylon fiber hose (C) of the water spray hose (A) deformed and displaced.
Figure 3:
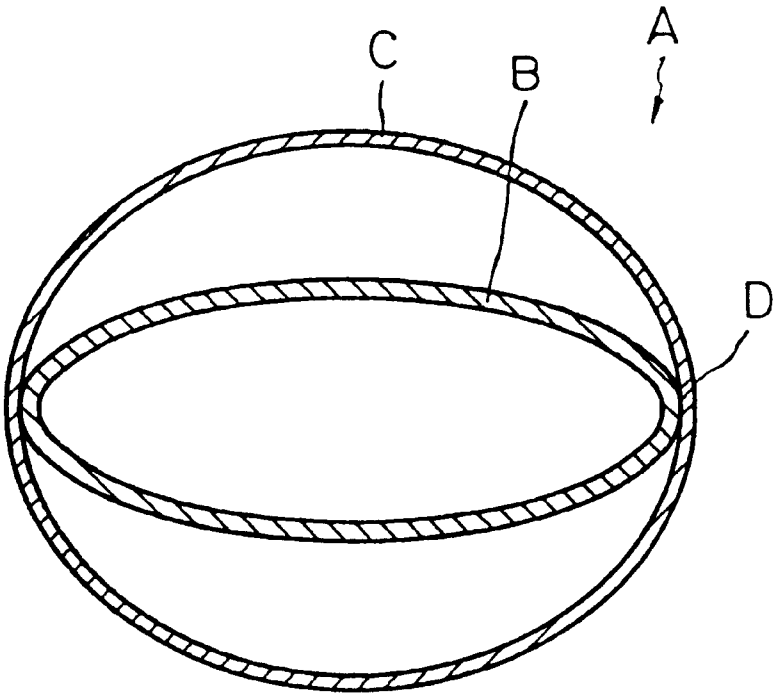
FIG. 3 (PRIOR ART)
FIG. 3 is a sectional view of the inner rubber hose (B) and the outer nylon fiber hose (C) of the water spray hose (A).
Figure 5:
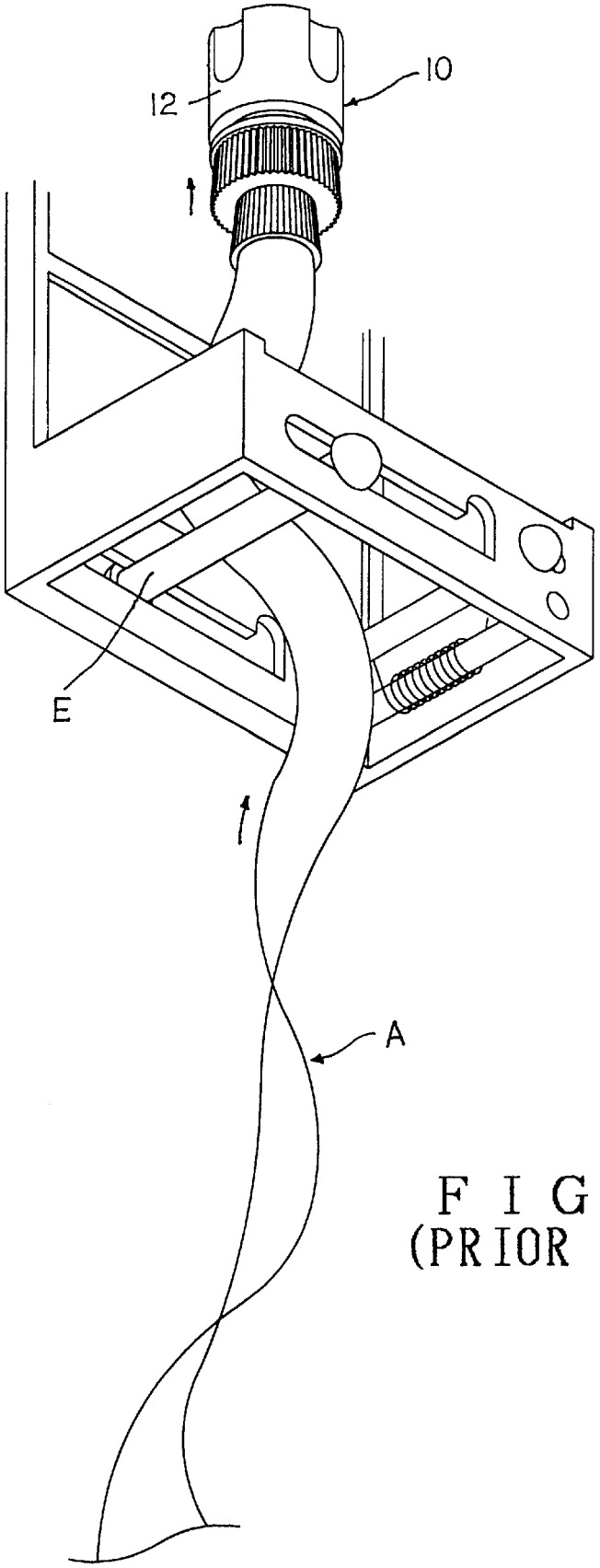
FIG. 5 (PRIOR ART)
FIG. 5 is an optional view showing the water spray hose (A) in a twisted condition.
Figure 7:
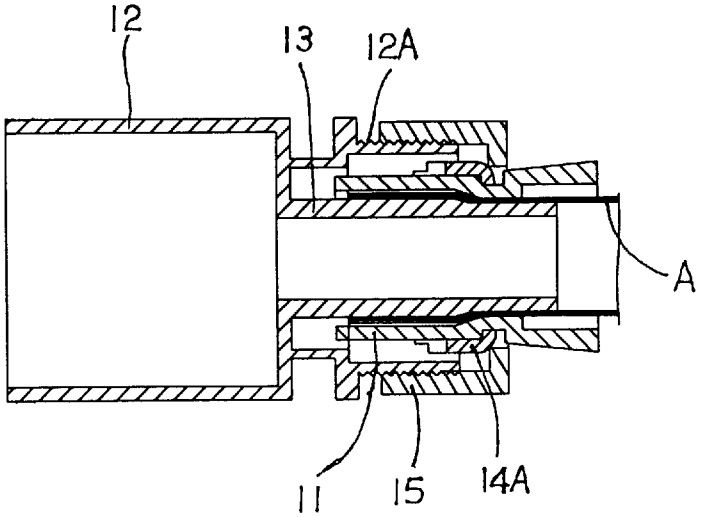
FIG. 7 (PRIOR ART)
FIGS. 6 and 7 are sectional views of the FIG. 2 assembly taken before and after the connector (10) and the water spray hose (A) are screwed together.
Figure 6:
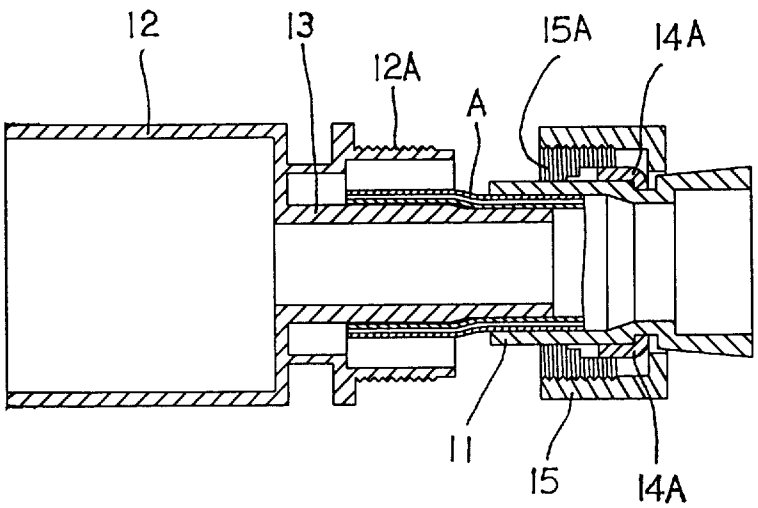
FIG. 6 (PRIOR ART)
Figure 8:
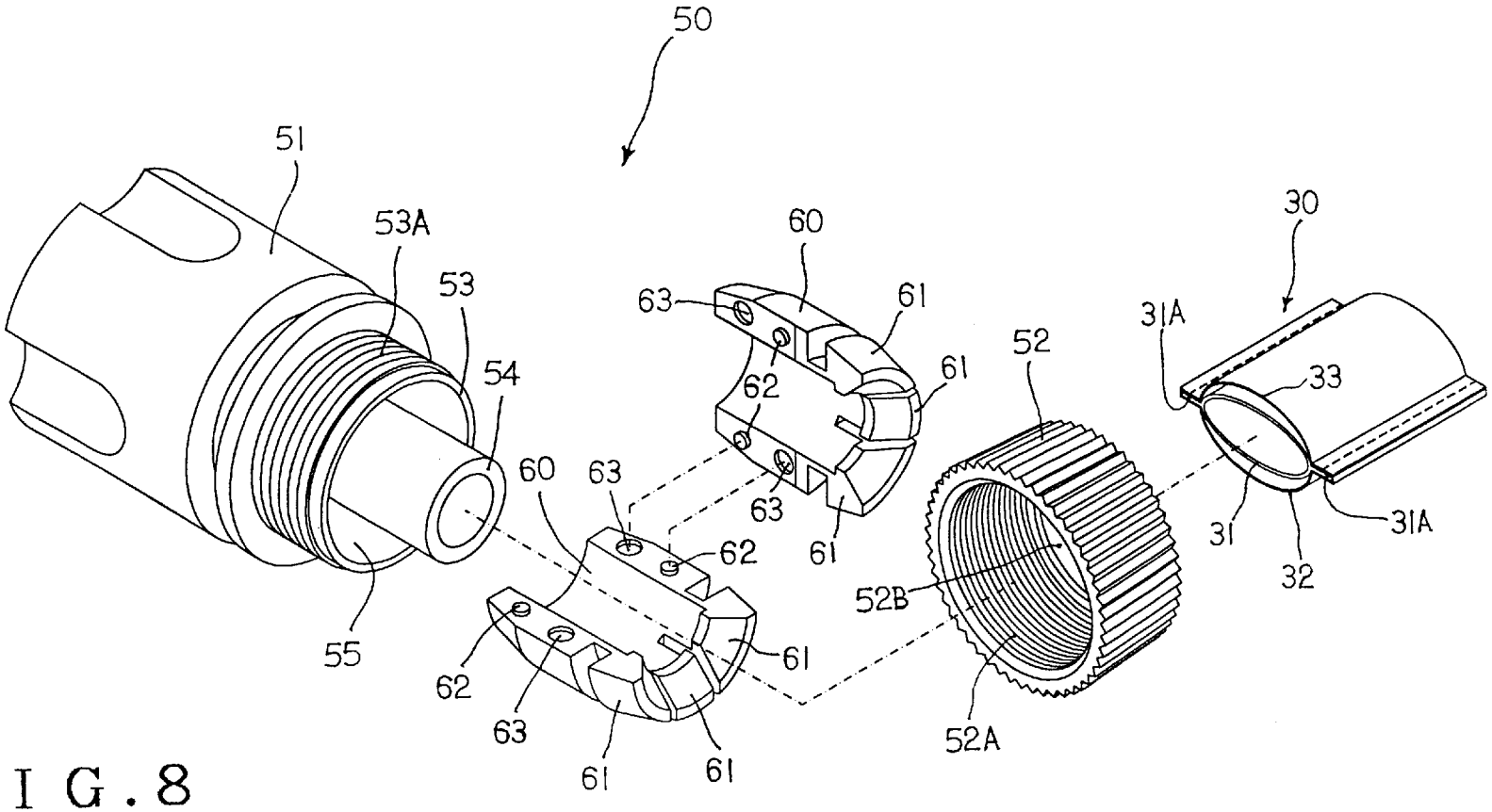
FIG. 8 is an exploded view of a connector (50) and a water spray hose (30) of the present invention.
Figure 9:
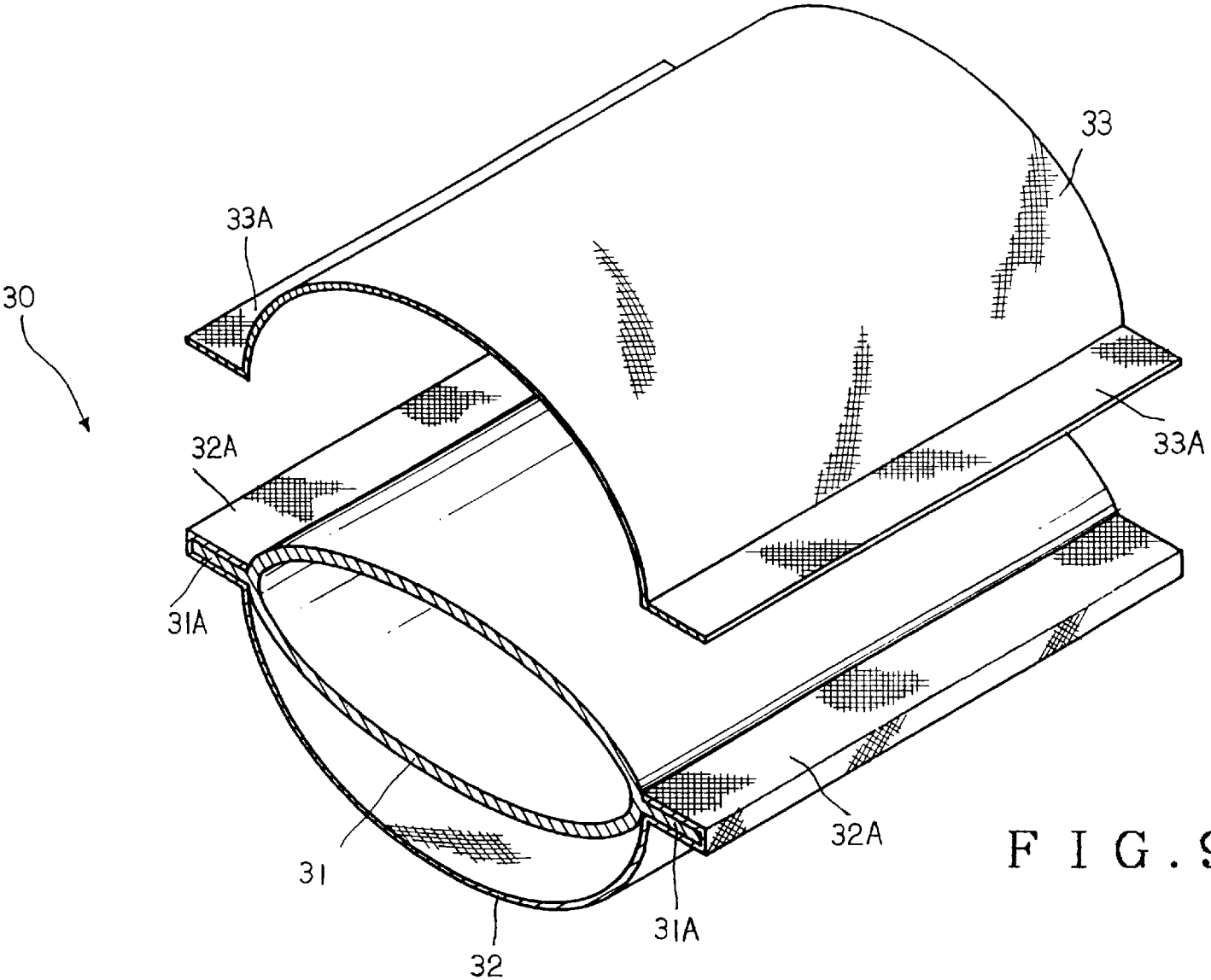
FIGS. 9 and 10 are breakdown view and sectional view of the water spray hose (30) of the present invention.
Figure 10:
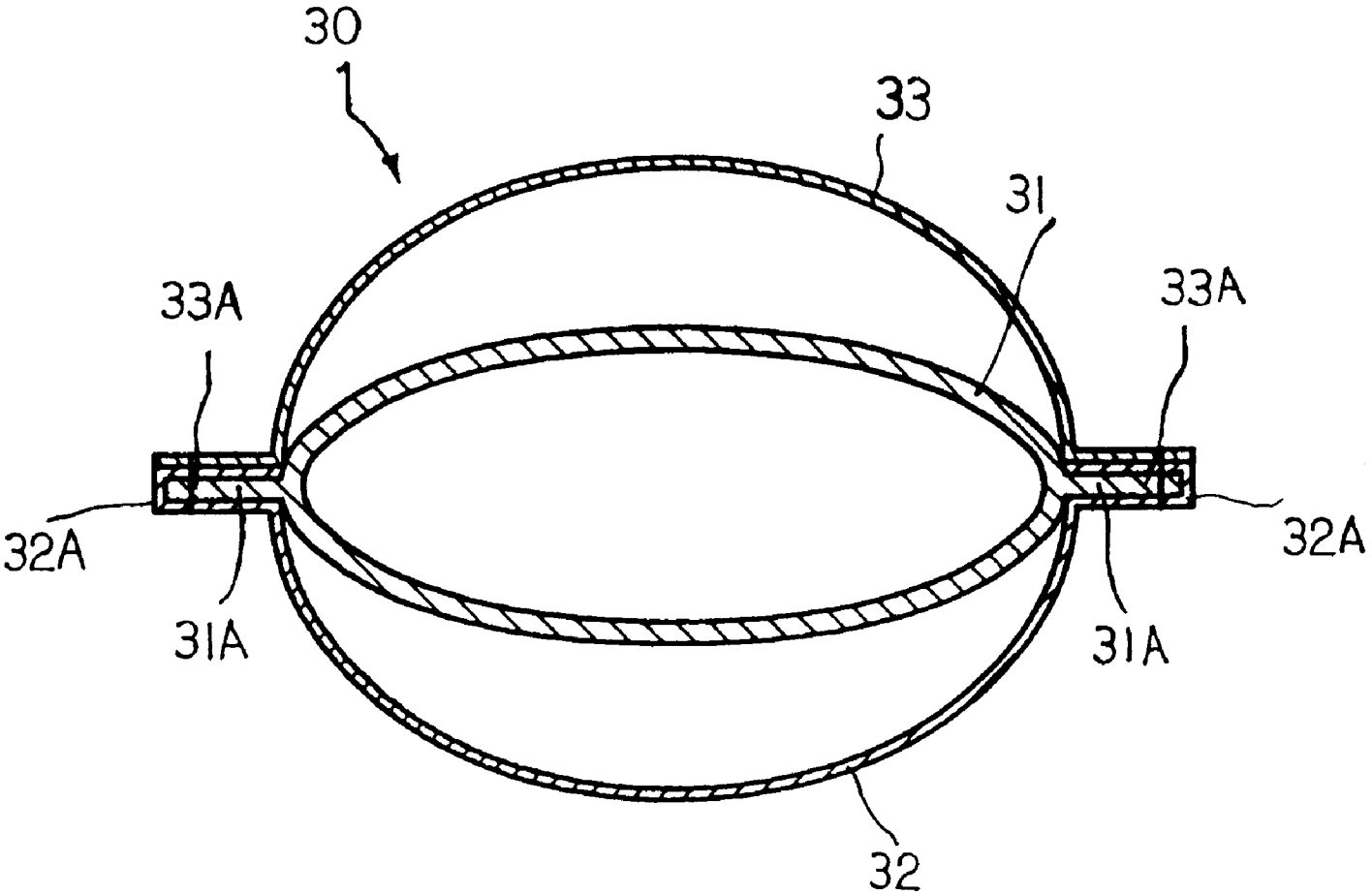

Referring to FIGS. 8, 9, and 10, a water spray hose (30) of the present invention in-cludes an oval-shaped rubber hose (31), a first nylon fiber layer (32), and a second nylon fiber layer (33). The rubber hose has flanges 31A at the hose fold lines. Flanges 31A are covered by edge areas 32A of the first nylon fibre layer 32 and edge areas 33A of the second nylon fibre layer 33. Edge areas 32A and 33A may be attached to flanges 31A by stitching.

Because of the inner rubber hose (31) construction and the outer nylon fiber coverings, when the water spray hose (30) is inserted into a holder (E) of the rolling device (100), the inner rubber hose (31) will not be separated or displaced from the nylon fibre coverings. This also makes it easy to roll the water spray hose and to squeeze out the residual water in the water spray hose to avoid residual foul water fouled and propagated germs.

Figure 11:
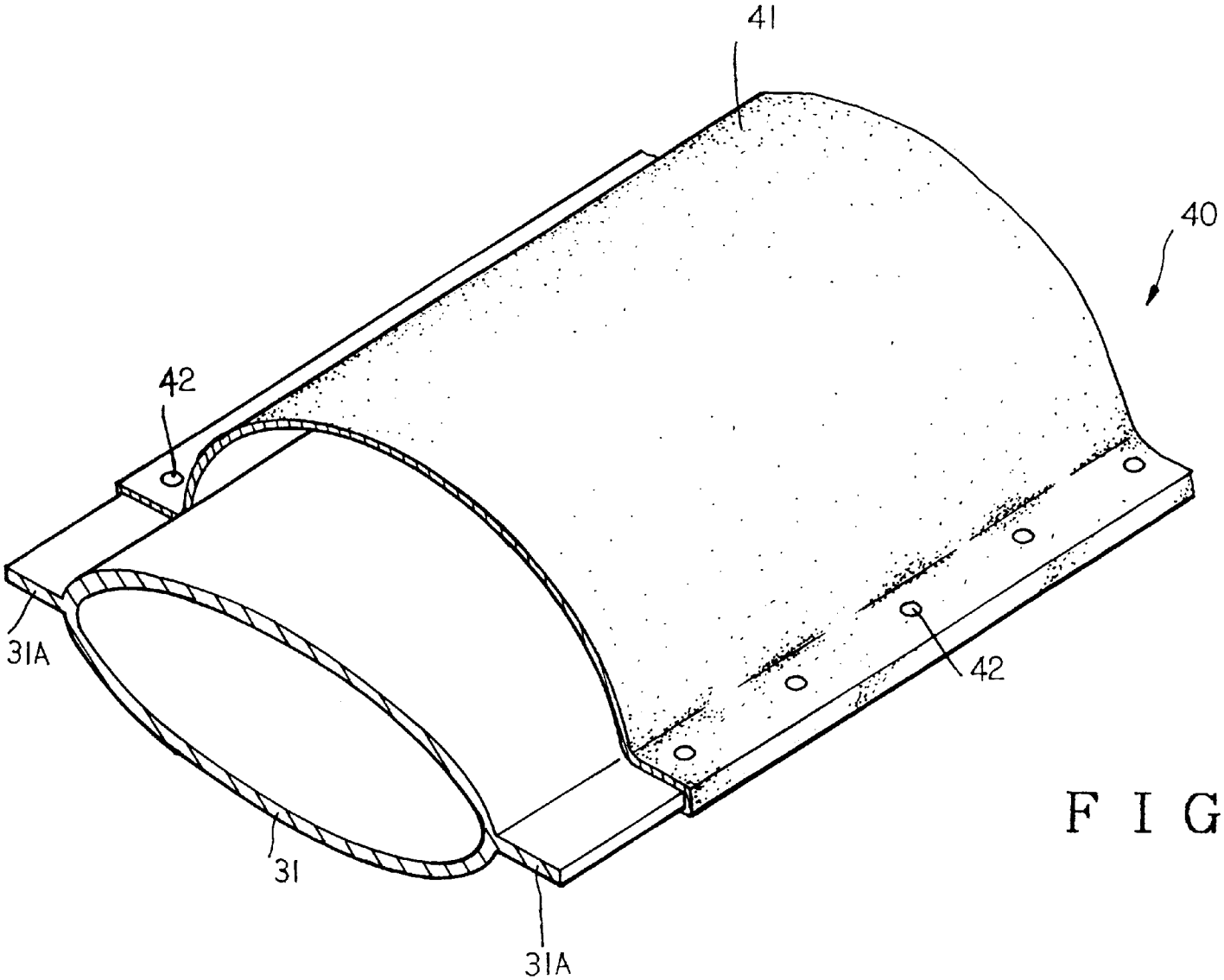
FIG. 11 is a section view of another type of water spray hose (40) of the present invention.

FIG. 11 shows another design of the water spray hose (40), which includes an inner rubber hose (31) with edge flanges (31A) at two sides, and a outer hollow nylon fiber covering (41). To connect and fix the rubber hose (31) and the nylon fiber hose (41), the two side edges of the nylon fiber covering (41) are wrapped around the two edge flanges of the rubber hose (31), then welded in-ultrasonically at about every five centimeters intervals. Multiple symmetrical welds (42) will be formed on the water spray hose (40).

Figure 13:
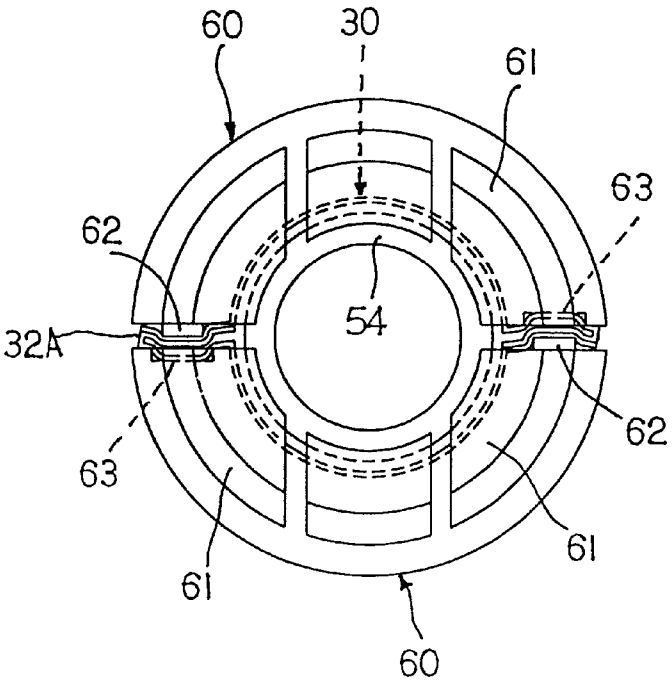
FIGS. 12 and 13 are sectional views of the FIG. 8 connector taken before and after the connector (50) and the water spray hose (30) are screwed together.
Figure 12:
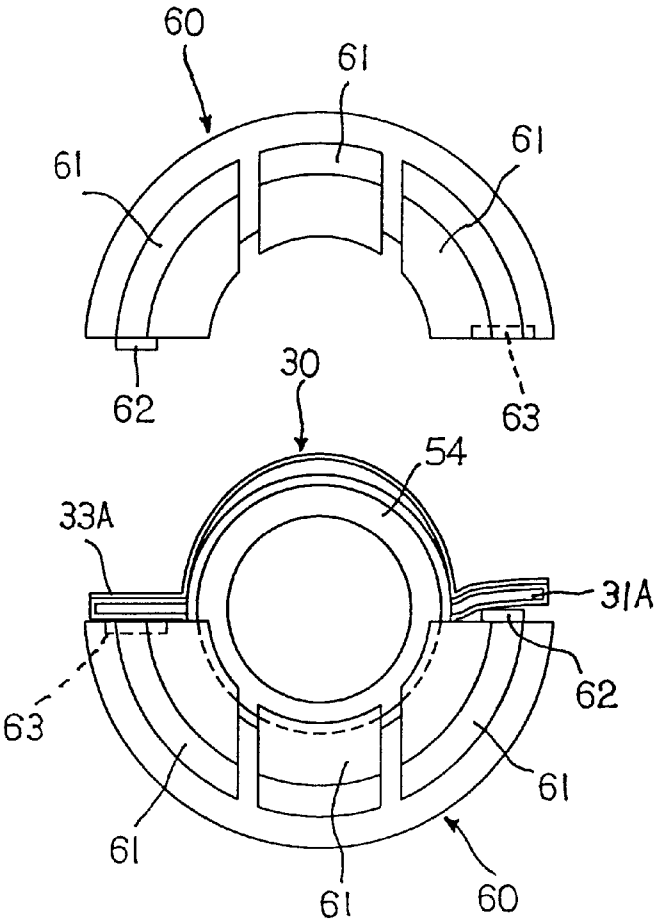

Referring to FIGS. 8, 12 and 13, the illustrated connector (50) consists of a primary coupling (51), a screw collar (52), and two semicircular splints (60).

The coupling includes an outer threaded tubular section 53 and an inner tubular section 54 that protrudes axially beyond tubular section 53 to telescopically receive an end portion of rubber hose 31 (that is locally deformed into a circular cross sects ion).

The two semicircular splints 60 fit around the end portion of flexible hose 30 that is retained on tubular section 53, with hose flanges 31A and edge areas 32A, 33A sandwiched between the flat radial surfaces of the splints. As shown in FIG. 8, the flat radial surfaces of splints 60 have tapering protuberances 62 and mating depressions 63 formed thereon, whereby the protuberances form depressions in the nylon edge areas 32A and 33A, as shown in FIG. 13.

Collar 52 is adapted to screw onto the threaded tubular section 53, to exert a clamp force on splints 60. End areas 61 of the splints are slotted, as shown in FIG. 8, so that areas become elastic. As collar 52 is screwed onto tubular section 53 the elastic end areas 61 are contacted by the inner edge of the collar, whereby end areas 61 are deflected inwardly to tightly grip the outer surfaces of hose 30. The hose 30 is thereby securely connected to the end connector so as to withstand water pressure forces.

From the above description, the improved structure of water spray hose device according to the present invention is novel in design and practical for use, and is therefore better and largely improved than the conventional water spray hose device.

What is claimed is:

1. A water spray hose assembly comprising:

an elongated flexible hose having two ends, and an end connector secured to each end of said hose;

said flexible hose comprising an elongated rubber water tube having an oval cross section that includes first and second symmetrical oval half sections integrally connected together to form two fold lines, and a flange (31A) extending radially outwardly from each fold line;

a first nylon fiber covering (32) overlying said first oval half section; and a second nylon fiber covering (33) overlying said second oval half section; said nylon fiber coverings having edge areas thereof secured to the flanges on said rubber tube;

each said end connector comprising a coupling having an externally threaded outer tubular section, and an inner tubular section protruding axially beyond said outer tubular section for telescopically receiving an end portion of said rubber water tube;

each said end connector further comprising two semi-circular cross-section splints collectively encircling the associated end of the flexible hose;

said splints having flat radial surfaces seatable against edge areas of the nylon fiber coverings, and elastic end sections (61) movable toward the inner tubular section of said coupling to exert a grip force on the hose;

each said end connector further comprising an internally threaded collar screwable onto said outer tubular section; said collar having an inner edge (at 52B) that exerts a cam force on the elastic end sections of said semi-circular splints when the collar is screwed onto said outer tubular section.

2. The water spray hose assembly of claim 1, and further comprising mating protuberances (62) and depressions (63) formed on said flat radial surfaces for enhanced gripment of said radial surfaces on edge areas of the nylon fiber coverings.

* * * * *